United States Patent [19]

Yanai et al.

[11] Patent Number: 4,861,950

[45] Date of Patent: Aug. 29, 1989

[54] MULTIPLE SWITCH DEVICE HAVING WATERPROOF STRUCTURE

[75] Inventors: Shinji Yanai; Yujiro Shimoyama, both of Furukawa, Japan

[73] Assignee: Alps Electric Co., Ltd, Japan

[21] Appl. No.: 160,520

[22] Filed: Feb. 26, 1988

[30] Foreign Application Priority Data

May 2, 1987 [JP] Japan ..... 62-74361[U]

[51] Int. Cl.[4] ..... H01H 9/04

[52] U.S. Cl. ..... 200/5 R; 200/302.2; 200/302.3

[58] Field of Search ..... 200/5 R, 302.1, 302.2, 200/303.3

[56] References Cited

U.S. PATENT DOCUMENTS 4,170,104 10/1979 Yamagata ..... 200/302.2

4,611,102 9/1986 Ishida ..... 200/5 R

FOREIGN PATENT DOCUMENTS 1297180 6/1969 Fed. Rep. of Germany ... 200/302.2

*Primary Examiner*—A. D. Pellinen

*Assistant Examiner*—Morris Ginsburg

*Attorney, Agent, or Firm*—Guy W. Shoup; Paul J. Winters; Edel D. Young

[57] ABSTRACT

A switch device having a casing, an actuator swingably supported to the casing, a plurality of projections suspended down from the lower surface of the actuator for changing over a switch by pressing a plurality of switch elements arranged in the casing which has a partition plate for separating the actuator and the switch element in the casing, a plurality of operation openings perforated at the partition plate for the actuators of the switch elements, and rubber pressing gaskets which transfer movement of the actuator projections to movement of switch elements and seal the upper portion of the casing from the lower portion in which the switch elements are located. Thus, the switch device can provide high waterproofness with a simple construction.

3 Claims, 4 Drawing Sheets

MULTIPLE SWITCH DEVICE HAVING WATERPROOF STRUCTURE

BACKGROUND OF THE INVENTION

1. Field of the Invention

This invention relates to a switch device for driving a plurality of switch elements by pressing an actuator at a plurality of positions in the surface thereof and, more particularly, to a waterproof structure for the switch device.

2. Description of the Prior Art

A switch device shown, for example, in FIGS. 3 and 4 is heretofore known as a switch for driving a mirror provided in a vehicle by an electric motor.

In the drawings, reference numeral 1 denotes an upper case opened at its lower end, and numeral 2 denotes a lower case for closing the open end of the upper case 1, and both cases 1 and 2 are snap-coupled to form the outer sheath of the switch device. A printed substrate 3 is placed on the lower case 2, and four lever switches 4 and a slide switch 5 are soldered to the printed substrate 3. The lever switch 4 is known to change over the switch by turning a lever **4*b* by pressing an L-shaped actuator 4*a* projected from the upper end thereof, and the slide switch 5 is known to change over the switch by sliding the operation lever 5*a*** projected from the upper end thereof.

A square stepped portions 6 and a flat-shaped track-like recess 7 are formed in parallel on the upper surface of the upper case 1. Operation openings 8 are perforated corresponding to the lever switches 4 at four corners of the stepped portion 6, and a projecting wall 10 having a through opening 9 is formed at the center of the stepped portion 6. An operation opening 11 is perforated along the longitudinal direction on the bottom of the recess 7.

Reference numeral 12 denotes a square actuator of plane shape, long pressing projections **12*a* are suspended down from four corners of the lower surface of the actuator 12, short projections 12*b* are suspended down from the intermediate positions of the pressing projections 12*a*, and further suspended with latch pawls 12*c* of the actuator 12. The actuator 12 thus formed is inserted into the stepped portion 6 with conical rubber pressing buttons 13 interposed between the bottom of the stepped portion 6 and the projections 12*b*, and the latch pawls 12*c* are latched with the lower peripheral edges of the projecting wall 10 to prevent it from being removed. Therefore, when the corner of the actuator 12 is pressed against the elastic tension of the rubber pressing button 13, the pressing projection 12*a* opposed to the lever switch 4 is moved down through the operation opening 8 to press the actuator, thereby selectively turning ON the lever switches 4**.

Reference numeral 14 denotes an operation knob. An operation shaft **14*a* suspended from the operation knob 14 is inserted into the operation opening 11 to be engaged with the operation lever 5*a* of the slide switch 5. Thus, when the operation knob 14 is moved along the longitudinal direction of the recess 7, the operation lever 5*a* reciprocates in cooperation therewith to switch the slide switch 5**.

Next, the operation of the switch device constructed as described above will be described When the operation knob 14 is reciprocated along the operation opening 11 as described above, the slide switch 5 is switched to select, for example, any of right and left mirrors. When the corner of the actuator 12 is depressed, the actuator 12 is tilted in the pressed direction, the pressing projection **12*a* of the position pressed as described above is moved down to turn ON the opposed lever switch 4. In this case, since the rubber pressing button 13 is deformed by the depression of the actuator 12, an operator can recognize the switching operation of the lever switch 4 as click feeling (knock feeling). When the pressing force is released, the actuator 12 is returned by the recoiling strength of the rubber pressing button 13 to the state as shown in FIG. 3. Therefore, one of four lever switches 4 is selectively turned ON by selecting the pressing position of the actuator 12 so that an electric motor, not shown, is started to transmit the driving force through a power transmission system, not shown, to the mirror of the side selected by the operation knob 14, thereby driving (tilting) the mirror in the pressing direction of the actuator 12**.

In the switch device constructed as described above, the pressing projection **12*a* suspended down from the actuator 12 moves elevationally in the operation opening 8 perforated at the upper case 1 to operate the switch element (lever switch 4). Thus, when liquid such as rainy water or drinking water is splashed over the switch device, the liquid is introduced into the upper case 11 through a gap formed between the upper end opening of the stepped portion 6 and the peripheral edge of the actuator 12. When the liquid is thus introduced into the upper case 1, there arises a problem that the wiring patterns of the printed substrate 3** or the contacts of the switch elements are shorted to cause a serious defect in the switch device.

SUMMARY OF THE INVENTION

Accordingly, an object of this invention is to provide a switch device which can eliminate the above-described drawbacks of the prior art and which can provide high waterproofness with a simple constitution.

In order to achieve the above and other objects of the invention, there is provided according to the present invention a switch device having a casing, an actuator swingably supported to the casing, a plurality of projections suspended down from the lower surface of the actuator of changing over a switch by pressing a plurality of switch elements arranged in the casing comprising a partition plate for separating the actuator and the switch element in the casing, a plurality of operation openings perforated at the partition plate for the actuators of the switch elements in such a manner that the operation openings are sealed by rubber pressing gaskets interposed between the projections and the actuator.

According to the present invention, a plurality of operation openings are perforated at the partition plate in the casing for the actuators of the switch elements and rubber pressing gaskets are placed on the partition plate to seal the operation openings. Thus, the pressing force of the actuator is transmitted through the gasket to the actuator, and an operator can confirm the switching operation of the switch element by a click feeling. Thus, since the operation opening is sealed by the gasket, even if liquid such as rainy water is introduced from the periphery of the actuator, the liquid is less transferred to the switch element side through the operation opening to prevent the contacts from improperly shorting.

The above and other related objects and features of the invention will be apparent from a reading of the following description of the disclosure found in the accompanying drawings and the novelty thereof pointed out in the appended claims.

DESCRIPTION OF THE PREFERRED EMBODIMENTS

Embodiments of a switch device according to the present invention will be described in detail with reference to the accompanying drawings.

Figure 1:
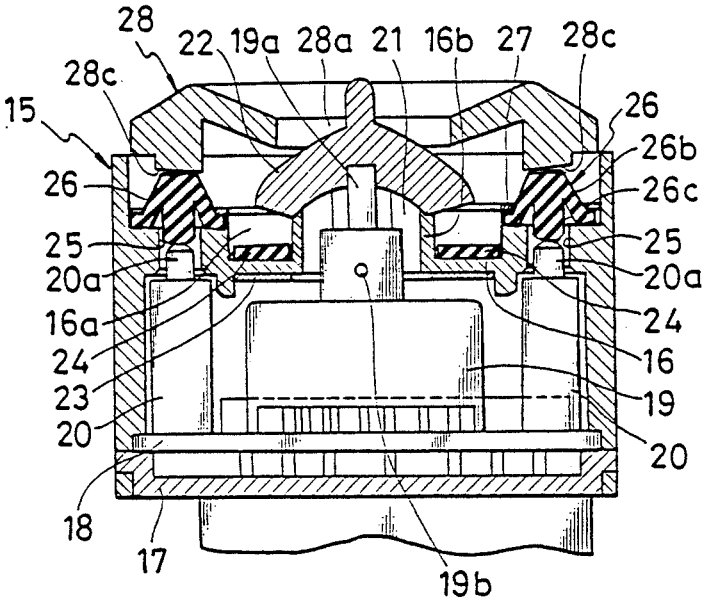
FIG. 1 is a sectional view showing an embodiment of a switch device according to the present invention.
Figure 2:
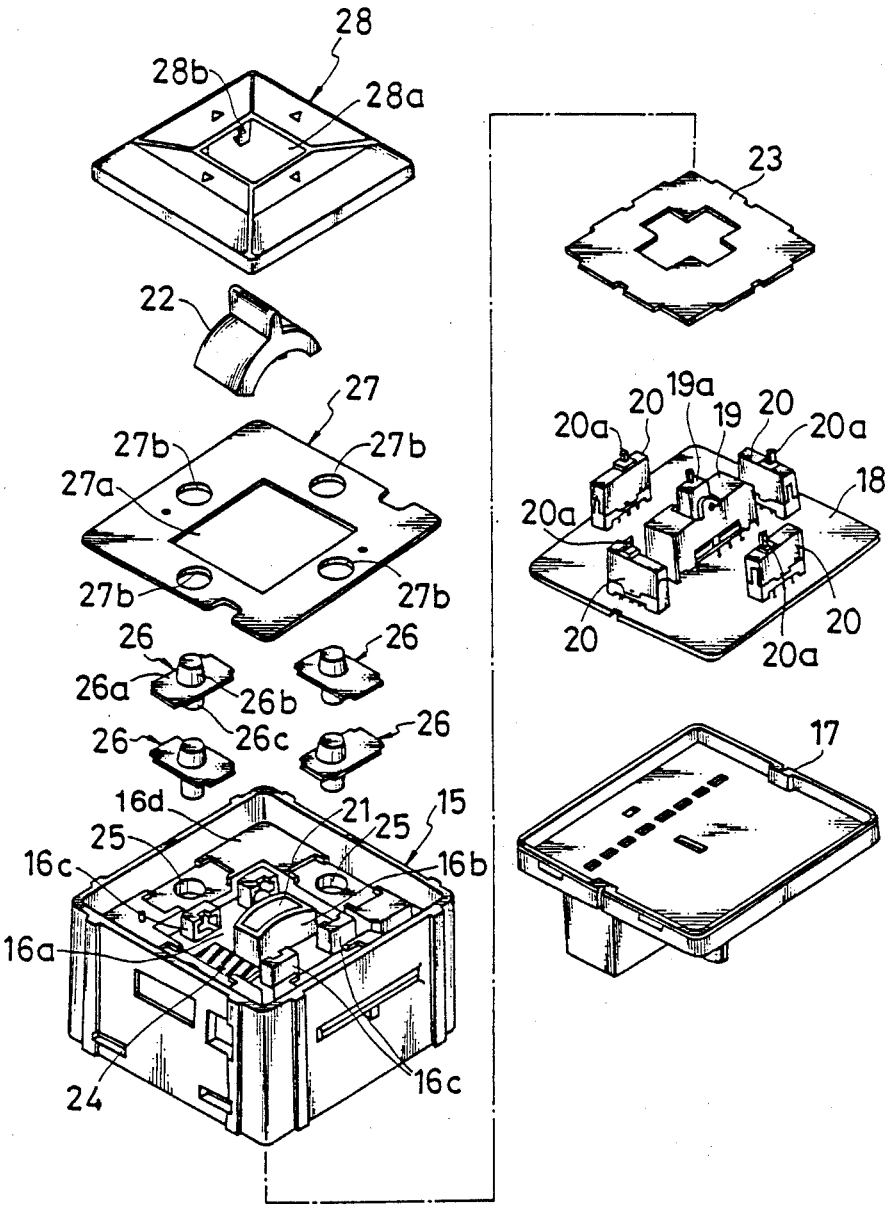
FIG. 2 is an exploded perspective view of the embodiment of the switch device.
Figure 3:
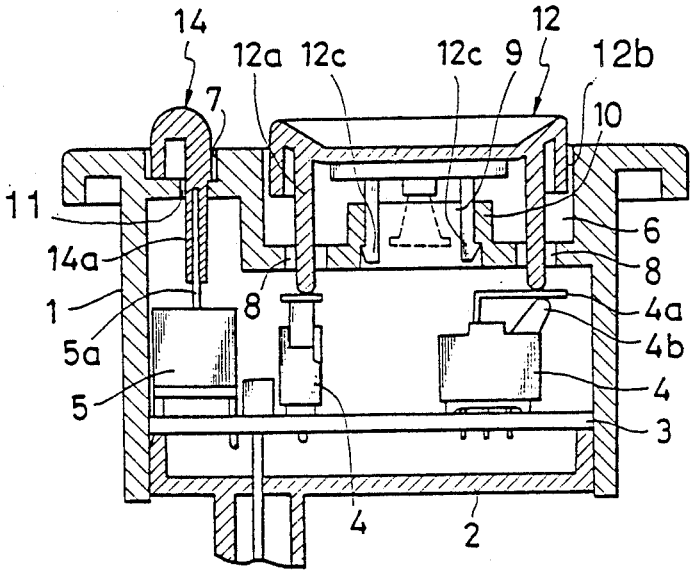
FIG. 3 (Prior Art)
FIG. 3 is a sectional view of a conventional switch device.
Figure 4:
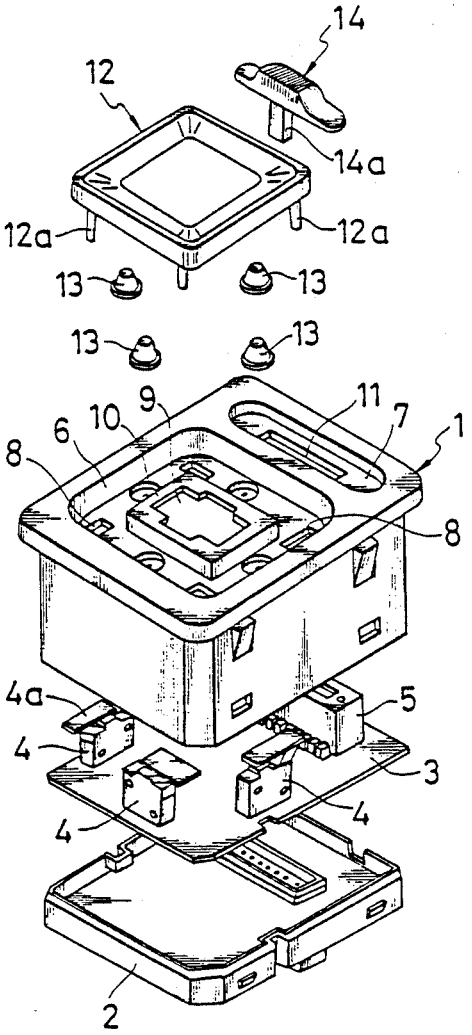
FIG. 4 (Prior Art)
FIG. 4 is an exploded perspective view of the conventional switch device.

FIG. 1 is a sectional view showing an embodiment of a switch device according to the present invention, and FIG. 2 is an exploded perspective view of the embodiment of the switch device.

In the drawings, reference numeral 15 designates an upper case opened at upper and lower ends and having a partition plate 16 therein at upper position. Numeral 17 designates a lower case for closing the lower open end of the upper case 15. Both cases 15 and 17 are snap-coupled to form the outer sheath of the switch device. A printed substrate 18 is placed on the lower case 17, a first switch element 19 is soldered to the center of the printed substrate 18, and second switch elements 20 are soldered to four positions on the periphery of the first switch element 19. The first switch element 19 is of seesaw type switch for changing over the switch by swinging a conductor plate, not shown, therein by rotating the actuator 19a projected upward at a supporting shaft **19*b* as a fulcrum, and the second switch element 20 is of a push type switch for changing over the switch by reciprocating the conductor plate, now shown therein by elevationally moving upward or downward by actuator 20*a*** projected upward.

A flat square-shaped stepped portion **16*a* is formed on the upper surface of the partition plate 16, and a rectangular through opening 21 is perforated at the center of the stepped portion 16*a*. A projecting wall 16*b* is projected upward from the peripheral edge of the through opening 21. The actuator 19*a* of the first switch element 19 is inserted into the through opening 21 to be projected upward of the partition plate 16, and an operation knob 22 is engaged fixedly with the upper end of the actuator 19*a***.

Four engaging walls **16*d* opened at the lower end and one side are projected from the four corners of the stepped portion 16*a*, and the lower open surfaces of the engaging walls 16*c* are closed by a cover 23 bonded to the lower surface of the partition plate 16. Two buffer plates 24 made of rubber are bonded adjacent the through openings 21 to the bottom of the stepped portion 16*a***.

Four operation openings 25 are perforated at the partition plate 16 disposed away from the stepped portion 16a. The actuator **20*a* of the second switch element 20 described above arrives at the operation openings 25, and the upper opening end of the operation opening 25 is covered by a rubber pressing gasket 26. The rubber pressing gasket 26 has a rectangular flange 26*a* of plane shape, a thin part 26*b* projected conically from the flange 26*a*, and a pressing part 26*c* suspended down from the lower surface of the thin part 26*b*. The pressing part 26*c* is contacted with the actuator 20*a* of the second switch element 20 in the operation opening 25. A retainer 27 having four circular openings 27*b* is placed fixedly on the periphery of the square-shaped through opening 27*a* at the center of the partition plate 16, and the rubber pressing gaskets 26 are interposed at the flanges 26*a* between the partition plate 16 and the retainer 27, and the thin part 26*b* is projected from the circular opening 27*b***.

Reference numeral 28 designate a square-shaped actuator of plane shape having an opening **28*a* at the center, two at one side, totally four latch pawls 28*b* are suspended down through the openings 28*a* from the lower surface of the actuator 28, and four pressing projections 28*c* are suspended down from the outside thereof. The actuator 28 is urged upward by the elastic tension of the rubber pressing gaskets 26 at the pressing projection 28*c* to be swingably supported to the upper case 15, and the latch pawls 28*b* are latched to the steps of the engaging wall 16*c* to prevent the upper case 15** from being removed.

When the operation knob 22 projected from the opening **28*a* of the actuator 28 is tilted at the supporting shaft 19*b* as a fulcrum, the first switch element 19 is switched to select, for example, any of right and left mirrors. In this case, since a buffer plate 24 is arranged on the end side of the operation knob 22 in the tilting direction, the operation knob 22 is not contacted directly with the partition plate 16** at the tilting time to absorb a collision sound.

When the arbitrary position of the actuator 28 is depressed, the pressing projection **28*c* in the depressed position presses the actuator 20*a* through the lower rubber pressing gasket 26 so that the second switch element 20 corresponding to the pressed position is turned ON. In this case, the pressed part 26*c* of the rubber pressing gasket 26 is moved down due to the deformation of the thin part 26*b*, and an operator can recognize the switching operation of the second switch element 20 by the deformation of the thin part 26*b* as a click feeling. When this pressing force is removed, the actuator 28 is returned to the state shown in FIG. 1 by the recoiling strength of the pressing gasket rubber 26 and the actuator 20*a* is similarly returned to the state shown in FIG. 1 by the recoiling strength of the return spring, not shown, in the second switch element 20, and the second switch element 20 is turned OFF. Thus, when the arbitrary position of the actuator 28 is pressed to selectively turn ON the four second switch elements 20, an electric motor, not shown, is started according to the ON signal, the driving force is transmitted similarly through a power transmission system, not shown to the mirror of the side selected previously to drive the mirror in the pressing direction of the actuator 28**.

Thus, when liquid such as rainy water or drinking water is splashed over the switch device, the liquid is immersed through the gap between the actuator 28 and the upper case 15 and the opening **28*a* of the actuator 28 to the upper portion of the partition plate 16, but the through opening 21 perforated at the partition plate 16 and the peripheral edge of the through opening 21 are provided with the projecting wall 16*b*, and the operation knob 22 is covered on the upper end, and the rubber pressing gasket 26 is covered on the upper end of the operation opening 25. Thus, there is almost no possibility of feeding the liquid via the through opening 21 and the operation opening 25 to the first and second switch elements 19, 20**.

In the embodiment described above, the case that the first switch element 19 for selecting the right and left mirrors and the second switch element 20 for driving the mirrors are arranged in the common casing has been described. However, they may be contained in separate casings, or the first switch element 19 may be omitted to use two switch devices for the right and left mirrors. In these cases, the through opening 21 of the partition plate 16 is eliminated to further enhance the waterproof effect of the switch device.

According to the present invention as described above, the pressing force of the actuator is transmitted through the rubber gasket for sealing the operation opening to the actuator of the switch element. Thus, there is almost no possibility that the liquid immersed erroneously into the casing is fed via the operation opening to the switch element side to provide the switch device having a simple structure and high waterproofness.

What is claimed is:

1. A switch device comprising:

a casing;

an actuator swingably supported to the casing, the actuator including a plurality of projections extending down from the lower surface of the actuator for actuating a switch;

a plurality of switch elements arranged in the casing such that each of the plurality of switch elements can be actuated by a corresponding one of the projections;

a partition plate separating the casing into an upper portion which includes the actuator and a lower portion which includes the switch elements, the partition plate being provided with holes through which the projections may communicate with the switch elements; and a plurality of pressing gaskets, each of the pressing gaskets being of unitary construction including a central downwardly extending pressing portion and a peripheral water sealing portion, each of the pressing gaskets being located in one of the holes such that the pressing portion can be contacted by a corresponding one of the projections and can in turn contact a corresponding one of the switch elements, and the peripheral portion being attached to the partition plate adjacent the one of the holes such that a waterproof seal is provided between the one of the projections and the corresponding one of the switch elements.

2. A switch device as in claim 1 in which a seesaw switch is further included in the lower portion of the casing;

the partition plate further includes a seesaw switch opening through which the seesaw switch can be operated;

the seesaw switch opening in the partition plate is surrounded by upwardly extending walls;

the seesaw switch includes an operating shaft which extends through the seesaw switch opening; and attached to a top end of the operating shaft is an operating knob having a cover which extends beyond the upwardly extending walls such that liquid falling upon the operating knob will fall outside the walls and not enter the lower portion of the casing.

3. A switch device as in claim 2 in which the actuator is perforated at a center portion and the operating knob is operated through the center portion.

* * * * *